US012440774B2

(12) United States Patent
Maldovan et al.

(10) Patent No.: US 12,440,774 B2
(45) Date of Patent: Oct. 14, 2025

(54) PLUSH TOY

(71) Applicant: Disney Enterprises, Inc., Burbank, CA (US)

(72) Inventors: Monty Maldovan, Kissimmee, FL (US); Sarah A. Flood, Orlando, FL (US)

(73) Assignee: DISNEY ENTERPRISES, INC., Burbank, CA (US)

( * ) Notice: Subject to any disclaimer, the term of this patent is extended or adjusted under 35 U.S.C. 154(b) by 228 days.

(21) Appl. No.: 18/451,387

(22) Filed: Aug. 17, 2023

(65) Prior Publication Data

US 2025/0058237 A1 Feb. 20, 2025

(51) Int. Cl.
*A63H 3/02* (2006.01)
*A63H 9/00* (2006.01)

(52) U.S. Cl.
CPC ..... *A63H 3/02* (2013.01); *A63H 9/00* (2013.01)

(58) Field of Classification Search
CPC ..... A63H 3/02; A63H 9/00
See application file for complete search history.

(56) References Cited

U.S. PATENT DOCUMENTS

| | | | | |
|---|---|---|---|---|
| 4,505,687 | A * | 3/1985 | Munro | A63H 3/02 446/385 |
| 7,887,387 | B2 * | 2/2011 | Colvin | A63H 3/005 446/379 |
| 11,311,814 | B2 * | 4/2022 | Medwed | A63H 3/02 |
| 11,623,156 | B1 * | 4/2023 | Medwed | A63H 3/02 446/369 |
| 2023/0102105 | A1 * | 3/2023 | Nigro | A63H 3/02 446/73 |
| 2024/0066419 | A1 * | 2/2024 | Bush-Rhoads | A63H 3/28 |

* cited by examiner

*Primary Examiner* — John A Ricci

(57) ABSTRACT

A plush toy having an outer fabric shell with an outer surface defining a desired shape for the plush toy and an in inner surface defining a void. A fiberfill layer covers an inner surface of the outer fabric shell. A foam inner inside the defined void, where the foam inner and the fiberfill layer are sized to completely fill the void such that the foam inner is not compressed while in a relaxed state, but can be compressed as a user interacts with the plush toy and that the fiberfill completely buffers the foam inner form direct contact with the outer fabric shell.

20 Claims, 4 Drawing Sheets

PLUSH TOY

BACKGROUND

Field of the Description

The present description relates, in general, to plush toys, and, more specifically, to plush toys having a viscoelastic inner that does not itself define the shape or appearance of the toy.

Relevant Background

Plush toys are a timeless toy style that continue to be enjoyed by children everywhere. conventional plush toys are constructed of an outer fabric or simulated fur shell defining an inner void that is filled with stuffing such as fiberfill, wool, loose foam and the like, but packed tightly enough against the outer fabric casing so as to retain their shape. Conventional stuffing, while soft and modestly compressible, is typically packed tightly enough that the toys are not easily compressed in a way that would deform the toy and so do not conform readily to a user's squeezing and hugging. When the stuffing is packed loosely enough to make the toy more enjoyable, the toy often fails expand into its original shape when deformed.

One example of a plush toy addressing this issue is found in U.S. Pat. No. 11,311,814 invented by Jeremy Medwed. This solution uses a foam inner that is larger than the outer shape of the toy and is a bit larger that the textile fabric outer covering. This design allows the foam inner to expand to entirely fill the shape defined by the fabric outer covering and ensure that the inner remains partially compressed and taught against the outer fabric cover. However, this results in a plush toy that is less soft and pliable for the user. Moreover, this design requires the foam inner to be formed with rather close tolerances which increases difficulty and expense in manufacturing.

Therefore, there is a need for constructions that allow a plush toy to be compressed and deformed during use and provide the user-friendly feel of a conventional plush toy without permanently deforming the plush toy or changing its shape during use. The present invention accomplishes these objectives.

SUMMARY

Briefly stated, the present disclosure describes a plush toy having an outer fabric shell with an outer surface defining a desired shape for the plush toy and an in inner surface defining a void. A fiberfill layer covers an inner surface of the outer fabric shell. A foam inner inside the defined void, where the foam inner and the fiberfill layer are sized to completely fill the void such that the foam inner is not compressed while in a relaxed state, but can be compressed as a user interacts with the plush toy and that the fiberfill completely buffers the foam inner form direct contact with the outer fabric shell.

DETAILED DESCRIPTION OF THE PREFERRED EMBODIMENTS

Figure 1:
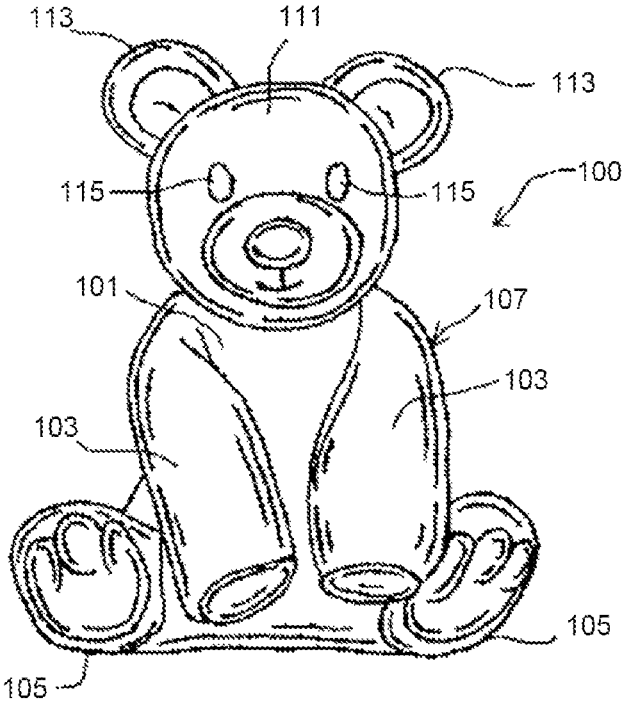
FIG. 1 illustrates a front view of a plush toy in accordance with the present disclosure.

Referring now to the drawings, wherein like reference numerals identify the same or similar elements throughout the several views, an embodiment of a plush toy 100. In the example of FIG. 1, plush toy 100 comprises a body portion 101 and a head portion 111 from which various implementation-specific appendages may extend such as arms 103, legs/feet 105 and ears 113. Some implementations would not have appendages, such as a snake or many non-animal shapes such as a ball, box or other object. In FIG. 1, head portion 111 is decorated with features such as eyes 115, which may be separate parts sewn, glued, or otherwise attached to head portion 111, or created by fabric paint, dyes or other fabric decoration techniques.

The overall shape of plush toy 100 is defined by an outer fabric shell 107. The outer fabric shell 107 may comprise one or more panels of flexible, preferably stretchable fabric. When multiple panels are used, the panels can be attached together by sewing, welding, adhesives or other available fabric joining techniques. The fabric type and construction of outer fabric shell 107 are chosen to be sufficiently flexible to deform during ordinary play, but also to tend to return to a baseline shape when play is done. Outer fabric shell 107 may be constructed into any shape such as an animal, doll, pillow, or geometric figure such as a ball, cube or the like.

Figure 2:
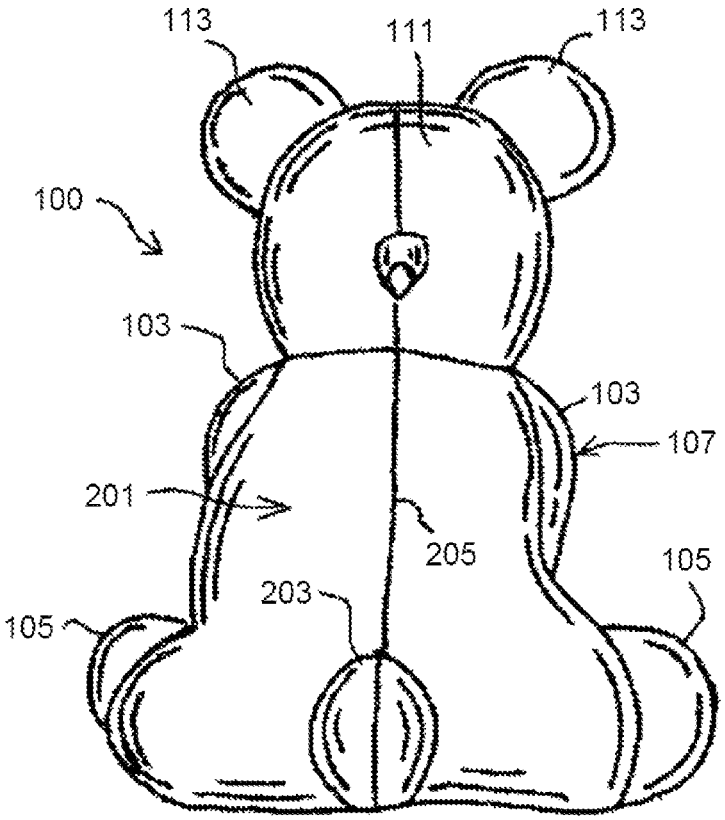
FIG. 2 a back view of the plush toy of FIG. 1.

In FIG. 2, toy 100 has a back surface 201 with perhaps other auxiliary features such as tail 203. Seam 205 would ordinarily be sewn shut, but may also be implemented by a zipper or other openable closure to allow access to the interior of plush toy 100.

Figure 3:
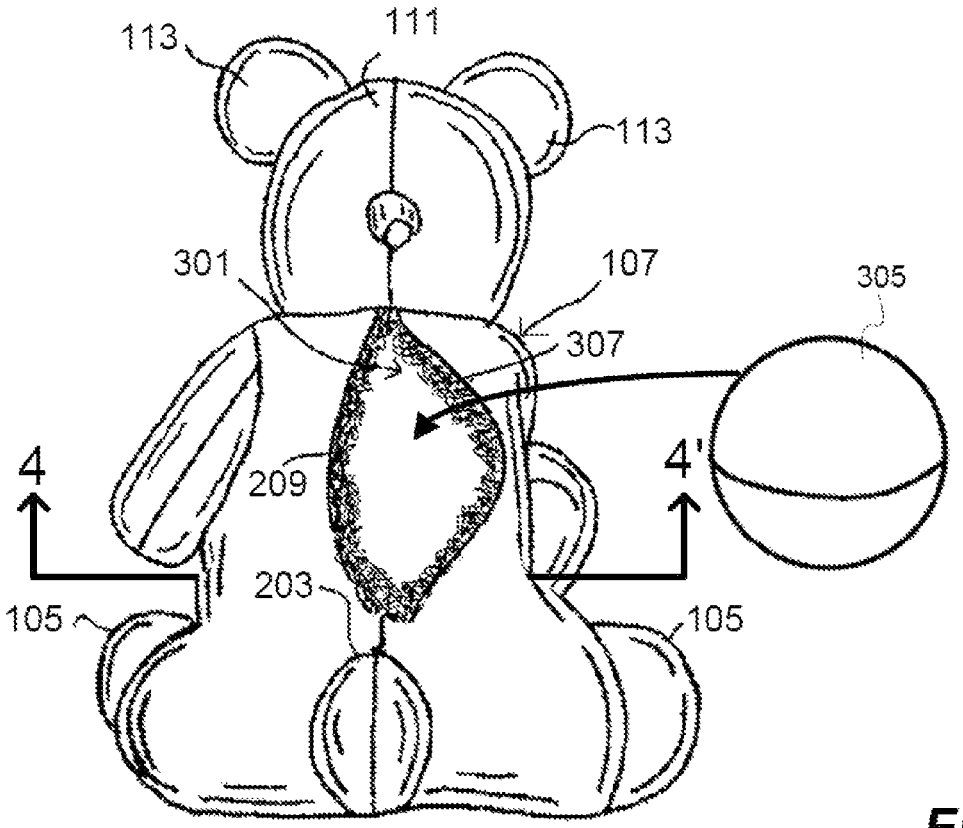
FIG. 3 shows a partially disassembled back view of the plush toy in accordance with the present disclosure.

FIG. 3 shows a partially disassembled view of plush toy 100. Interior void 301 is defined by the interior surfaces of outer fabric shell 107. A layer of fiberfill 307 lines an interior surface of outer fabric shell 107. The layer of fiberfill 307 need not be uniform thickness and in most implementations will not be uniform thickness. The layer of fiberfill 307 may comprise a single density fiberfill, or may comprise various densities to provide the desired tactile feel for a particular application. The layer of fiberfill 307 may comprise a synthetic material such as polyester, a natural material such as wool, or loose fill such as foam beads, beans, or other known fill material that is sufficiently hygenic and resiliently conformable to allow the plush toy 100 to be deformed during use and yet substantially return to a defined shape when not in use.

Foam inner 305 is shown outside of plush toy 100 in FIG. 3, but it should be understood that a finished product would typically have foam inner 305 inside void 301 and secured by sealing seam 205 (shown in FIG. 2). Foam inner 305 preferably comprises a compressible open-cell or closed-cell viscoelastic foam material. Foam inner 305 is smaller in all dimensions than void 301 defined by outer fabric shell 107. In this way, foam inner 305 does not touch outer fabric shell 107 and is preferably always buffered from outer fabric shell 107 by some part of fiberfill layer 307. Foam inner 305 functions to enhance the tactile feel of plush toy 100 and to enable greater compression and distortion of the plush toy 100 during play but does not, by itself, expand to return the plush toy 100 to its original shape when released. It is the combined action of foam inner 305 and layer of fiberfill 307 that cooperate to provide the enhanced tactile experience of a highly deformable plush toy with the resilience to return to substantially its original form when released. When released to its original form, foam inner 305 is not substantially compressed.

Foam inner 305 can be of any shape to meet the needs of a particular application as it does not need to have a shape that matches the shape of outer fabric shell 107. This creates a great deal of design freedom in allowing complex shapes that provide variable compressibility across plush toy 100. This feature also enables the use of easily manufactured shapes such as spheres, cubes, cylinders, pyramids, and the like rather than closely fitted shapes required by prior techniques.

Plush toy 100 may have multiple separate parts such as body 101, head 111, arms 103 legs/feet 105, and ears 113, and each of these parts may be filled using the construction in accordance with the present disclosure, or some may be filled more conventionally with a stuffing such as fiberfill, wool, cotton or the like.

Figure 4:
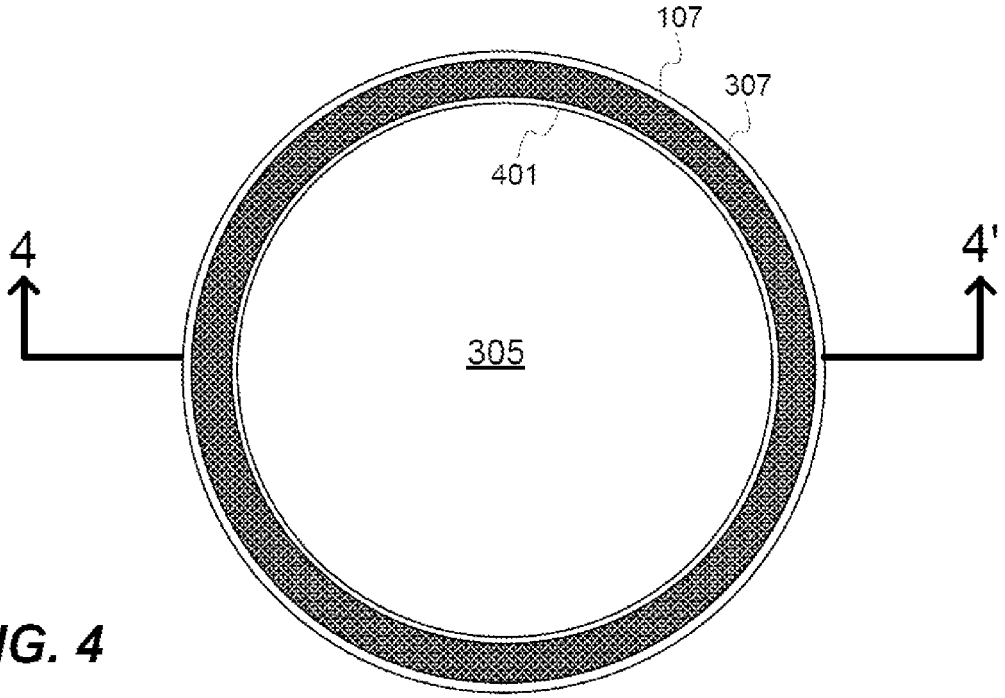
FIG. 4 shows a magnified view of a foam inner core in accordance with the present disclosure.

FIG. 4 show a cross section taken generally through the line 4-4' shown in FIG. 3, although FIG. 4 shows the cross-section with foam inner 305 installed rather than deconstructed. Foam inner 305 may optionally be covered with a flexible mesh 401 that serves to protect an outer surface of foam inner 305 during manufacture and use. Mesh 401 is optional and can be implemented by any available mesh fabric that protects foam inner 305 during manufacture and is sufficiently deformable to avoid impacting the desired tactile performance of the combined action of foam inner 305 and layer of fiberfill 307. Preferably, layer of fiberfill 307 completely buffers the outer surface of foam inner 305, or mesh 401 when used, from the inner surface of outer fabric shell 107.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

The invention claimed is:

1. A plush toy comprising:

an outer fabric shell having an inner surface defining a void;

a foam inner inside the void; and a fiberfill layer between the inner surface of the outer fabric shell and an outer surface of the foam inner;

wherein the foam inner is not compressed while in a relaxed state, and wherein the fiberfill layer buffers the foam inner from direct contact with the outer fabric shell.

2. The plush toy of claim 1, wherein the outer fabric shell is stretchable.

3. The plush toy of claim 1, wherein the fiberfill layer comprises polyester.

4. The plush toy of claim 1, further comprising a mesh layer surrounding the foam inner.

5. The plush toy of claim 1, wherein;

the outer fabric shell has an outer surface defining a desired shape for the plush toy, and the foam inner has a shape that does not correspond to the desired shape.

6. The plush toy of claim 1, wherein the foam inner comprises a viscoelastic foam.

7. The plush toy of claim 1, wherein;

the outer fabric shell has an outer surface defining a desired shape for the plush toy, the desired shape comprises a plurality of body parts, at least one of the plurality of body parts contains the fiberfill layer and the foam inner, and at least one other of the plurality of body parts contains only fiberfill stuffing.

8. The plush toy of claim 1, wherein the fiberfill layer has a non-uniform thickness.

9. The plush toy of claim 1, wherein the fiberfill layer comprises material having different densities.

10. The plush toy of claim 1, wherein the fiberfill layer lines the inner surface of the outer fabric shell.

11. The plush toy of claim 1, wherein the fiberfill layer covers an outer surface of the foam inner.

12. The plush toy of claim 1, wherein:

the foam inner and the fiberfill layer are sized to completely fill the void, and the foam inner is compressible as a user interacts with the plush toy.

13. A construction for stuffing a void defined by a fabric shell, the construction comprising:

a foam inner; and a fiberfill buffer covering an outer surface of the foam inner, wherein the foam inner and the fiberfill buffer are sized to completely fill the void defined by the fabric shell such that the foam inner is not compressed while in a relaxed state, but can be compressed as a user interacts with the construction.

14. The construction of claim 13, wherein the fiberfill buffer comprises polyester.

15. The construction of claim 13, further comprising a mesh layer surrounding the foam inner.

16. The construction of claim 13, wherein the foam inner comprises a viscoelastic foam.

17. A method of constructing a stuffed object, the method comprising:

forming a fabric outer shell having an inner surface defining a void;

placing a foam inner inside the void, wherein the foam inner has a size that is smaller than the fabric outer shell;

filling space between the foam inner and the inner surface of the fabric outer shell with a fiberfill material such that the foam inner is not compressed; and closing the fabric outer shell such that the foam inner and the fiberfill material are sealed within the void.

18. The method of claim 17, wherein:

(i) the fiberfill material comprises polyester, (ii) the foam inner comprises a viscoelastic foam, or (iii) a combination of (i) and (ii).

19. The method of claim 17, further comprising:

surrounding the foam inner with a mesh layer.

20. The method of claim 17, wherein filling the space between the foam inner and the inner surface of the fabric outer shell with the fiberfill material comprises:

lining the inner surface of the fabric outer shell with the fiberfill material, or covering an outer surface of the foam inner with the fiberfill material.

* * * * *